US005363910A

United States Patent [19]

Baba et al.

[11] Patent Number: 5,363,910

[45] Date of Patent: Nov. 15, 1994

[54] HEAT EXCHANGER

[75] Inventors: Norimasa Baba, Nagoya; Ken Yamamoto, Obu; Michiyasu Yamamoto, Chiryu; Ryouichi Sanada, Obu; Eiichi Torigoe; Mitsugu Nakamura, both of Kariya, all of Japan

[73] Assignee: Nippondenso Co., Ltd., Kariya, Japan

[21] Appl. No.: 974,724

[22] Filed: Nov. 13, 1992

[30] Foreign Application Priority Data

Nov. 15, 1991 [JP] Japan ..... 3-300626

[51] Int. Cl.[5] ..... F28F 9/04

[52] U.S. Cl. ..... 165/153; 165/173; 165/178; 285/188; 285/222

[58] Field of Search ..... 165/78, 153, 173, 178; 29/890.052, 205, 513; 11/890.043, 205, 890.039; 285/222, 188

[56] References Cited

U.S. PATENT DOCUMENTS

| | | | |
|---|---|---|---|
| 2,169,993 | 8/1939 | Booth | 165/153 |
| 2,221,934 | 11/1940 | Ferris | 29/890.043 |
| 2,538,859 | 1/1951 | Bradfield | 285/188 |
| 2,894,534 | 7/1959 | Kennedy | 285/188 |
| 3,310,869 | 3/1967 | La Porte et al. | 29/890.03 |
| 3,978,687 | 9/1976 | Calzadilla | 165/178 X |
| 4,195,943 | 4/1980 | Williams | 285/222 |
| 4,547,943 | 10/1985 | Hoeffken | 165/178 X |
| 4,569,390 | 2/1986 | Knowlton et al. | 165/149 |
| 5,072,710 | 12/1991 | Washizu | 285/222 |
| 5,125,454 | 6/1992 | Creamer et al. | 165/153 |
| 5,163,716 | 11/1992 | Bolton et al. | 165/173 |
| 5,236,044 | 8/1993 | Nagasaka et al. | 165/173 |

FOREIGN PATENT DOCUMENTS

| | | | |
|---|---|---|---|
| 0360362 | 3/1990 | European Pat. Off. . | |
| 1291617 | 3/1962 | France | 165/153 |
| 1151087 | 10/1989 | Japan . | |
| 1151088 | 10/1989 | Japan . | |
| 79994 | 4/1991 | Japan | 165/173 |
| 2090652 | 7/1982 | United Kingdom . | |

*Primary Examiner*—John Rivell
*Assistant Examiner*—L. R. Leo
*Attorney, Agent, or Firm*—Cushman Darby & Cushman

[57] ABSTRACT

An inner half cylinder and an outer half cylinder are brazed to each other to form a cylindrical header tank. Both ends of tubes are connected to the inner half cylinder. An opening of the outer half cylinder is communicated with an opening of a joint pipe. A tongue portion which is provided on the periphery of the opening of the outer half cylinder is inserted and curled in the opening of the joint pipe so as to fix the joint pipe on the outer half cylinder firmly.

10 Claims, 7 Drawing Sheets

FIG.12 PRIOR ART
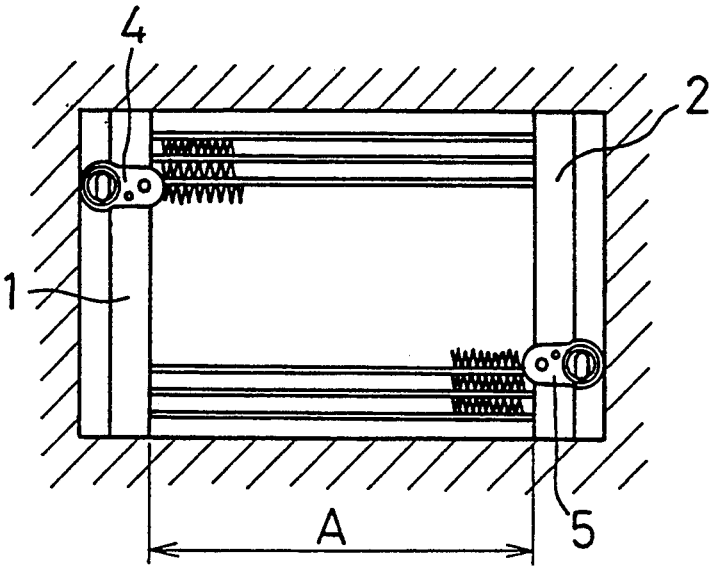
FIG.13
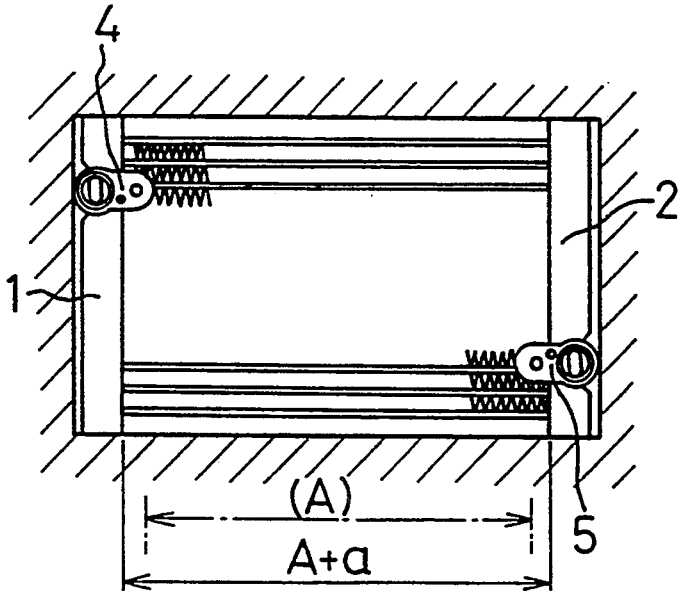

HEAT EXCHANGER

BACKGROUND OF THE INVENTION

The present invention relates to heat exchangers especially to those used as a condenser in a refrigeration system.

A conventional heat exchanger has a plurality of tubes, a pair of header tanks and joint pipes on the header tanks. In such a heat exchanger, one end of the joint pipe is inserted into an opening of the header tank and is brazed temporarily. After that, the joint pipes, the header tanks and tubes are brazed together in a furnace.

In other conventional heat exchangers, after brazing the tubes to the header tanks, the joint pipes are brazed to the header tanks. Since it is more difficult to maintain a relative position between the joint pipes and the header tanks than between the tubes and the header tanks during a brazing operation, the brazing of the header tanks and the joint pipes is carried out independently.

Japanese laid opened utility model publication Nos. 1-151087 and 1-151088 show a heat exchanger which has a joint block to which a joint pipe is inserted and brazed. The joint block has a concave surface on which the header tank is brazed. The joint pipe is kept stable in the brazing operation by such a construction.

As described above, it is necessary to braze the joint pipe independently or else the joint block is required to keep the joint pipe stable during the brazing operation, thus requiring additional steps of processing and a high cost is incurred.

In the conventional heat exchanger, the joint pipe projects out from the outline of the heat exchanger, which reduces the amount of space available for mounting other parts in an engine room.

SUMMARY OF THE INVENTION

An object of the present invention is to reduce the process steps required to make the heat exchanger and to reduce the space necessary for mounting the same in the engine room.

The header tank is comprised of an inner cylinder half and an outer cylinder half which has an opening. A tongue portion is provided at a periphery of the opening and is inserted and curled into a connecting hole of a joint pipe.

In a preferred embodiment of the present invention, a flat surface is formed around the opening of the outer half of the header tank, to which a flat surface of the joint pipe is connected.

A heat exchanging fluid flows into the inlet header tank through the inlet joint pipe and flows out from the outlet header tank through the outlet joint pipe after flowing through the pipes. The inner half of the header tank and the outer half of the header tank are brazed to each other so as to make the cylindrical header tank. Both ends of the tubes are inserted and brazed to the connecting holes of the inner half of the header tank. The opening of the outer half of the header tank communicates with the connecting hole of the joint pipe.

Since the tongue portion is curled outwardly in the connecting hole of the joint pipe, the joint pipe and the header tank are connected with each other firmly.

BRIEF DESCRIPTION OF THE DRAWINGS

FIG. 12 is a front view of a conventional condenser;

FIG. 13 is a front view of a condenser of the present invention;

DETAILED DESCRIPTION OF THE PREFERRED EMBODIMENTS

A condenser which is used in an air-conditioner for an automobile is described hereinafter.

Figure 1:
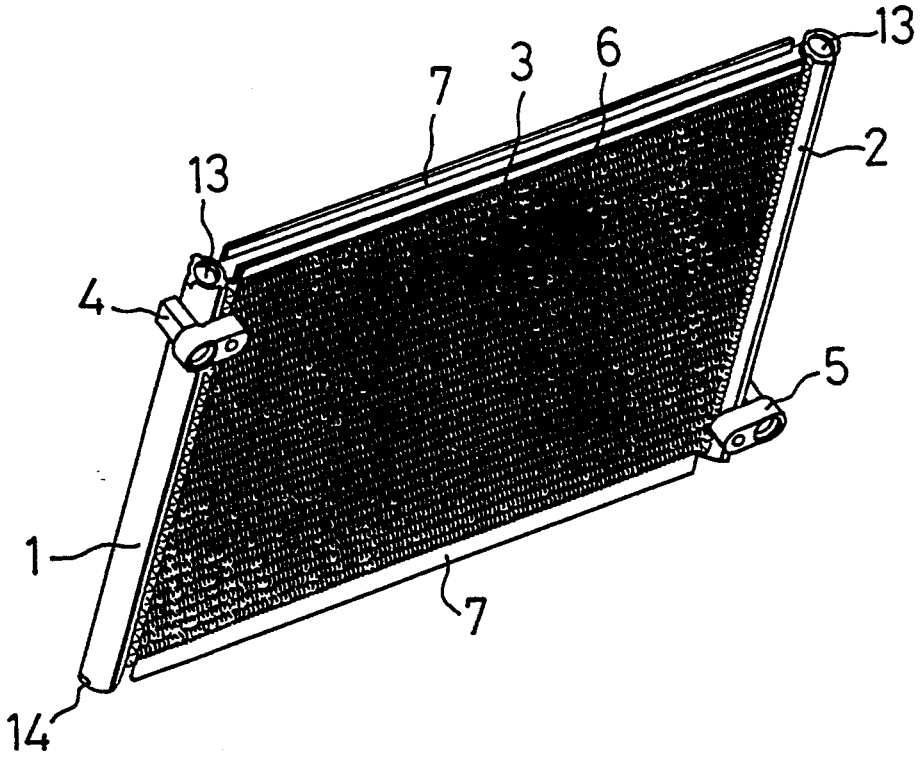
FIG. 1 is a perspective view of a condenser.
Figure 2:
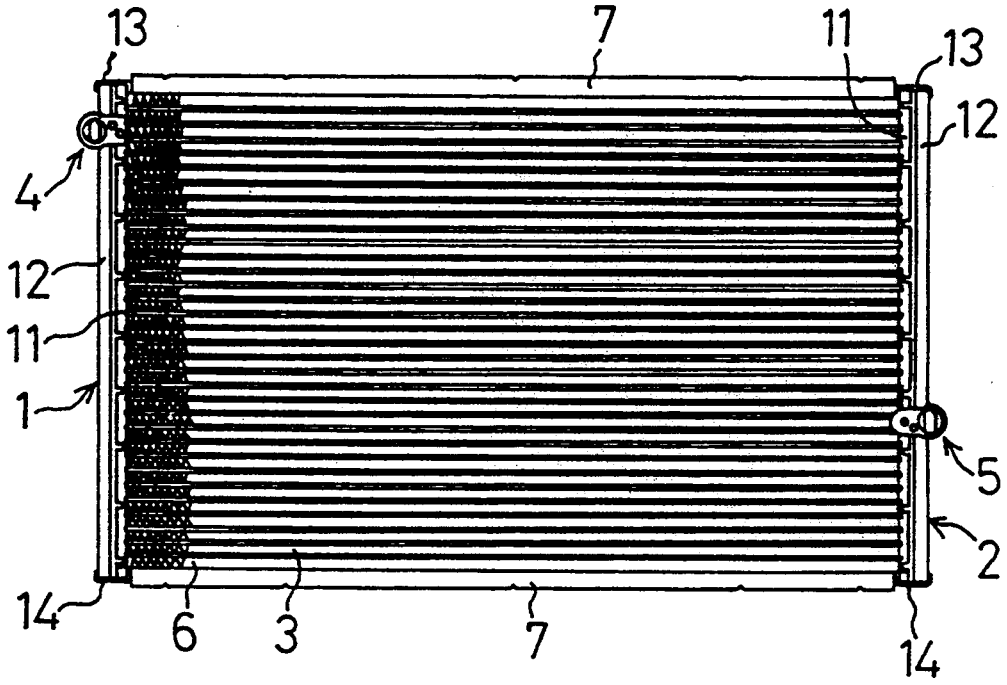
FIG. 2 is a front view of the condenser.

As shown in FIGS. 1 and 2, the condenser has a pair of header tanks 1,2 which are disposed in parallel with a predetermined distance there between. A plurality of tubes 3 are communicated with the header tanks 1,2 at both ends thereof, and corrugated fins 6 are provided between adjacent tubes 3. Joint pipes 4,5 are connected to each of the header tanks 1,2 respectively. A pair of frames 7 are provided at upper side and bottom side of the tubes 3, which are connected with the header tanks 1,2 at both ends thereof. All members described above are made from aluminum alloy.

Since the header tank 1 and the header tank 2 have the same configuration, the following description only refers to header tank 1.

Figure 10:
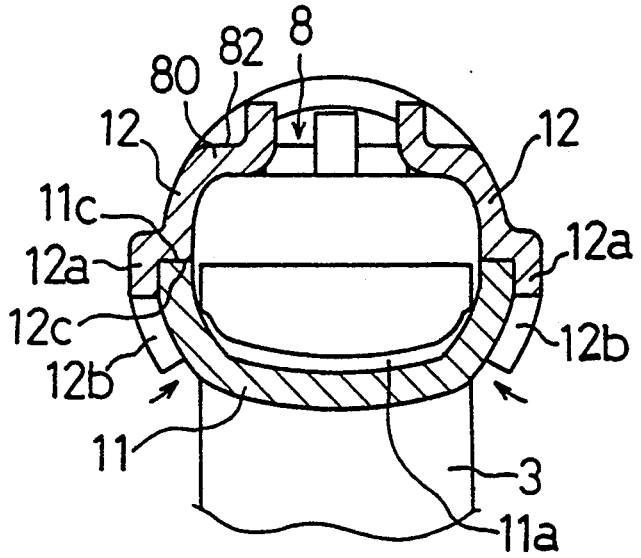
FIG. 10 is a cross-sectional view showing the assembly of the outer half and the inner half of the header tank.
Figure 11:
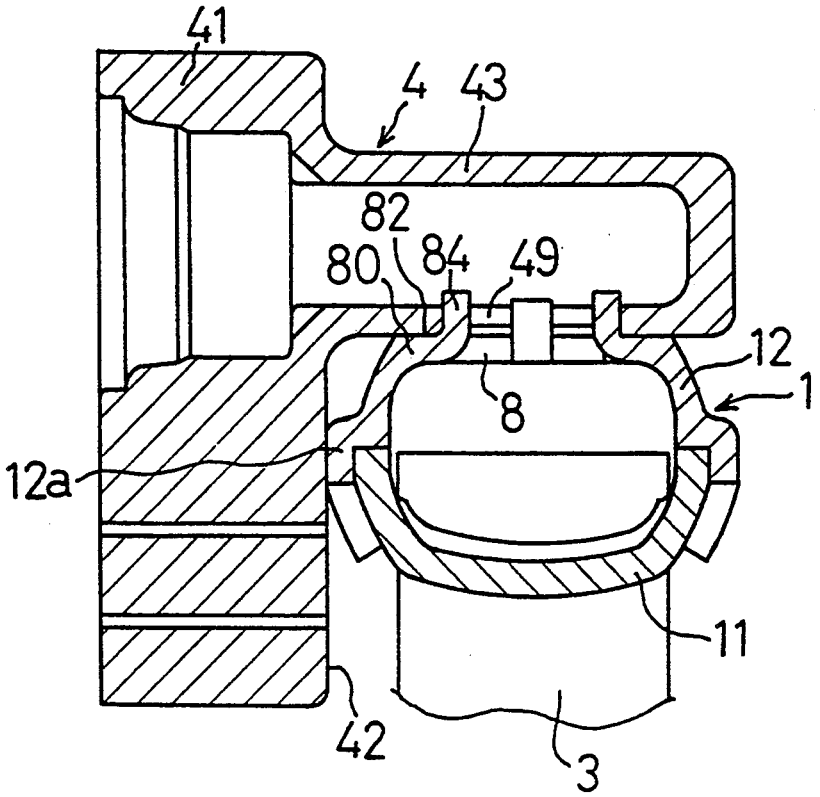
FIG. 11 is a cross-sectional view of the joint pipe and the header tank.

The header tank 1 is cylindrical and is comprised of an inner half cylinder 11, an outer half cylinder 12 and end caps 13, 14 as shown in FIG. 10. The outer surfaces of both half cylinders 11, 12 and the tubes 3 are covered with a brazing material (not shown) in 10 μm thickness.

The inner half cylinder 11 is formed by bending an aluminum strip into a half cylindrical shape, and has a plurality of connecting holes with a constant distance, to which one end of the tubes 3 is inserted respectively. As shown in FIG. 10, a rib **11*a* is formed along the periphery of the connecting hole, which is projected into the inside of the header tank 1. The rib 11*a* increases the contacting surface between the tube 3 and the inner half cylinder 11**.

Figure 3:
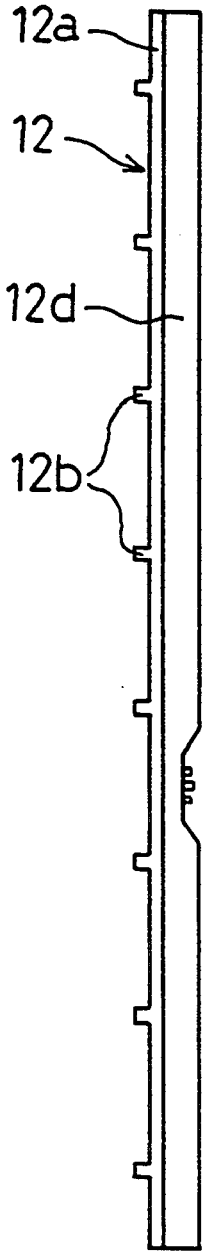
FIG. 3 is a side view of a outer half of an header tank.
Figure 4:
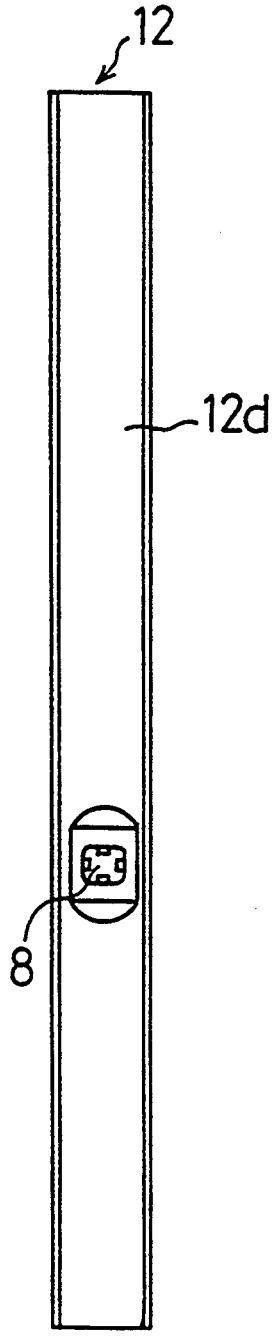
FIG. 4 is a front view of the outer half of the header tank.

The outer half cylinder 12 is also formed by bending aluminum strip into the half cylindrical shape, and has an opening 8 thereon. As shown in FIG. 10, the outer half cylinder 12 has large radius bent edges **12*a* longitudinally which is projected outwardly in the thickness of the inner half cylinder 11. A plurality of nail portions 12*b* are provided on the ends of the large radius bent edges 12*a*, which is projected in vertical direction against the longitudinal direction of the outer half cylinder 12. As shown in FIG. 3, eight nails 12*b* are provided at a constant spaced relation on each edge side of the outer half cylinder 12 respectively. The outer half cylinder 12, as shown in FIG. 10, has flat contacting surfaces 12***c* to which end surfaces 11*c* of the inner half cylinder 11 is contacted. The nail portions 12*b* are curled in such a manner that the nail portions 12*b* embrace the under surface of the inner half cylinder 11 while keeping the contact of the flat contacting surfaces 12*c* and the end surfaces 11*c*. The outer half cylinder 12 and the inner half cylinder 11 are secured to each other, so that a cylindrical header tank 1 is constructed.

Figure 5:
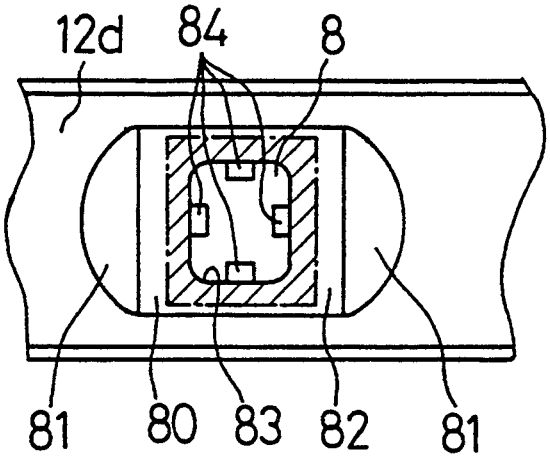
FIG. 5 is an enlarged front view of a portion of the outer half of the header tank.
Figure 6:
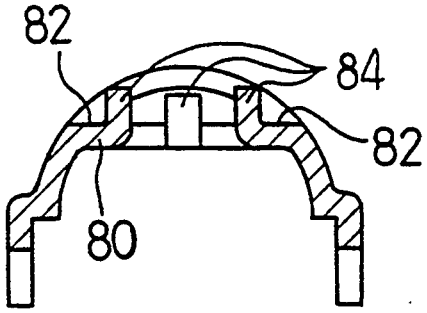
FIG. 6 is an enlarged cross-sectional view of the outer half of the header tank.

FIG. 5 and FIG. 6 show an opening 8 on the outer half cylinder 12. A flat portion 80 is formed on the outer surface 12*d* of the outer half cylinder 12 by pressing the cylindrical surface plastically. The square opening 8 is formed at the center of the flat portion 80. A crescent portion 81 is a transitional area from the cylindrical surface 12*d* into the flat portion 80. Four tongue portions 84 are provided at each side of the opening 8 along the periphery 83 thereof.

As shown in FIG. 1, a pair of end caps 13,14 are provided on both ends of the header tank 1 respectively.

Since the joint pipe 4 and the joint pipe 5 have the same configuration, the following description only relates to joint pipe 4.

Figure 7:
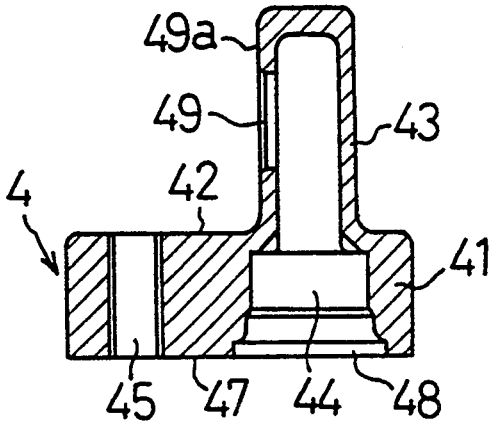
FIG. 7 is a cross-sectional view of the joint pipe.
Figure 8:
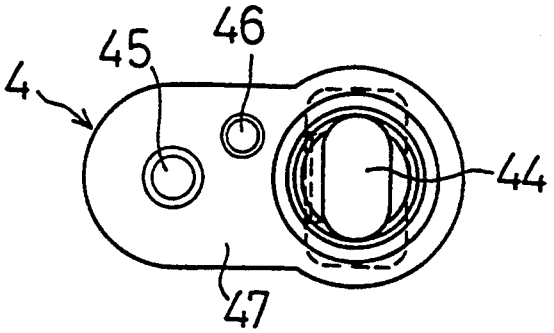
FIG. 8 is a front view of the joint pipe.

The joint pipe 4 is formed by die-casting, and has a rectangular base portion 41 and a hollow portion 43 which is connected integrally to a surface 42 of the base portion 41 as shown in FIG. 7 and FIG. 8. The base portion 41 has a refrigerant pass 44, a female screw 45 and a positioning hole 46 therein. The refrigerant pass 44 communicates an opening 48 on a flat surface 47 with an opening 49 on an outer surface 49*a* of the hollow portion 43. The opening 49 of the joint pipe 4 has the same shape as the opening 8 of the outer half cylinder 12. The hollow portion 43 has a rectangular parallelepiped shape as shown by a broken line in FIG. 8.

The female screw 45 and the positioning hole 46 penetrate the base portion 41 of the joint pipe 4.

The way of assembling the condenser is described hereinafter. A aluminum strips are stamped out from a plate and bent so as to form the inner half cylinder 11 and the outer half cylinder 12. Tongue members or tongue portions 84 are bent upwardly.

Figure 9:
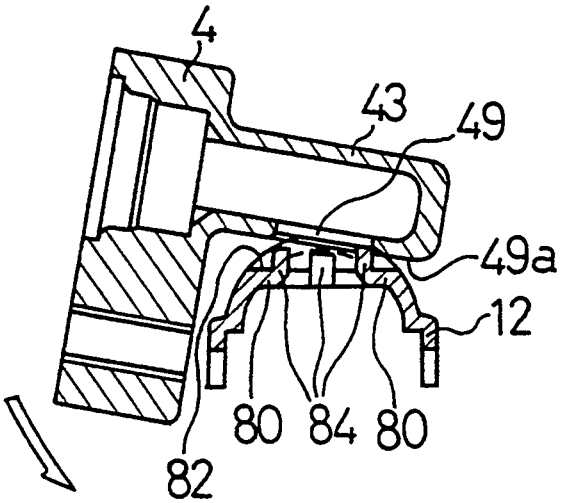
FIG. 9 is a cross-sectional view showing a way of assembling the joint pipe and the header tank.

As shown in FIG. 9, the tongue portions 84 are inserted into the opening 49 of the joint pipe 4, and then the outer surface 82 of the flat portion 80 and the flat outer surface 49*a* of the hollow portion 43 are placed in contact with each other.

The tongue portions 84 are bent outwardly by a jig (not shown) which is inserted into the opening 8 from the inner side of the outer half cylinder 12 so as to connect the joint pipe 4 with the outer half cylinder 12 while the surface 42 of the base portion 41 is contact with the outer surface of the large radius bent edge 12*a* whereby the contacting area of the joint pipe 4 with the header tank 1 is increased.

The corrugated fins 6 are disposed between adjacent tubes. Then both ends of tubes 3 are inserted into connecting holes (not shown) of the inner half cylinder 11, and both ends of the frame 7 are engaged with a concave portion (not shown) of the header tanks 1,2. The nail portions 12*b* are curled to combine both of the half cylinders 11,12, so that the cylindrical header tank 1 is formed.

The end caps 13,14 are disposed on both ends of the header tank 1.

After assembling all the parts, a wire (not shown) is rounded over the assembled condenser so as to prevent scattering of the parts. The wired condenser is taken to a furnace (not shown) to be brazed.

In the furnace, the brazing material on the tubes 3 and the header tanks 1,2 is melted, after that, the melted brazing material is solidified. A shadowed area in FIG. 5 is a brazing area at which the header tank 1 and the joint pipe 4 are contact with each other.

The brazed condenser is equipped in the engine room and the refrigerant pipe (not shown) is connected to the refrigerant pass 44 so as to form a refrigerating cycle.

The advantages of the present embodiment are described below.

Since the header tank 1 and the joint pipe 4 are brazed to each other at large area, which is the shadowed area on the flat portion 80 in FIG. 5, the joint pipe is connected to the header tank 1 airtightly.

The four tongue portions 84 prevent the relative movement of the joint pipes 4,5 and the header tanks 1,2 before brazing.

Since the refrigerant pass 44 in the joint pipe 4 has a vertical direction against the longitudinal direction of the tubes 3, the joint pipe 4 is projected sideward less than a conventional joint pipe which has a parallel refrigerant pass to the tubes 3.

As shown in FIG. 12 and FIG. 13, the flat portion 80 on the header tank 1 reduces the width of the condenser in pressing amount (a) of the flat portion 80 compared with the condenser which has not flat portion.

Figure 14:
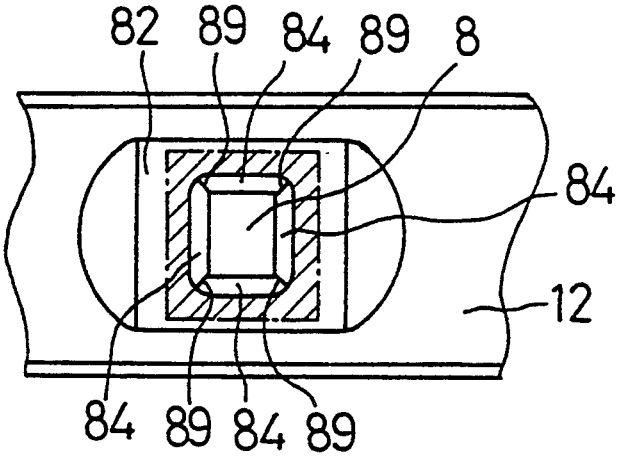
FIG. 14 is an enlarged front view of a portion of another header tank.
Figure 15:
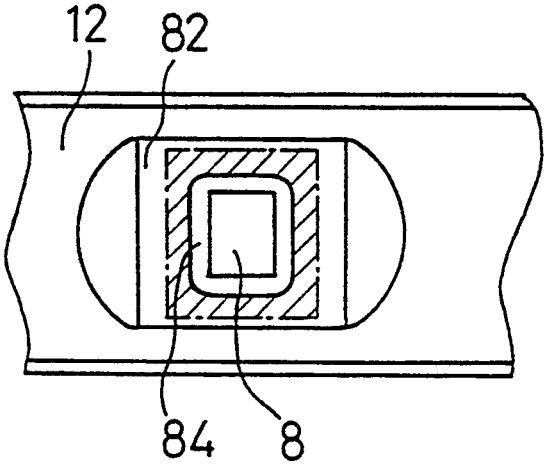
FIG. 15 is an enlarged front view of a portion of another header tank.

FIG. 14 and FIG. 15 show other embodiments of which the tongue portions 84 are not curled yet.

In the embodiment shown in FIG. 14, the tongue portion 84 is formed along the whole length of the periphery of the opening 8. Four slits are formed at each corner of the tongue portion 84.

In the embodiment shown in FIG. 15, the tongue portion 84 has no slit thereon and is projected upwardly to be cylindrical, whereby the mechanical strength of the tongue portion 84 is increased and the contacting area is increased.

What is claimed is:

1. A heat exchanger, comprising;

a pair of header tanks adapted to carry a refrigerant therein, at least one of said header tanks being provided with curled tongue members;

at least one tube connected to said header tanks and enabling said header tanks to be in fluid communication with one another; and a pair of joint pipes each connected to a respective one of the header tanks and adapted to communicate said header tanks with a refrigerant pipe, said joint pipes each having an opening therein, and said at least one header tank having the curled tongue members thereof being disposed within the opening of the respective joint pipe to which it is connected, said curled tongue members of said at least one header tank being in contact with portions of said respective joint pipe in a manner which secures said at least one header tank to said respective joint pipe.

2. A heat exchanger according to claim 1, wherein said at least one header tank is brazed to said respective joint pipe.

3. A heat exchanger, comprising:

first and second header tanks, at least one of which comprises an inner and outer portion, said outer portion having a first flat surface generally disposed about a first opening therein, said outer portion having a plurality of curled tongue members projecting outwardly from said first flat surface and disposed generally about said first opening;

a plurality of tubes adapted to carry a heat exchange medium therethrough, said tubes each having opposite ends connected to a respective one of said header tanks so as to permit said header tanks to be in fluid communication with one another;

first and second joint pipes connected to said first and second header tanks respectively, at least a predetermined one of said joint pipes having a second flat surface generally disposed about a second opening therein; and said outer portion having i) said curled tongue members thereof disposed in the second opening of said predetermined one of said joint pipes in a manner which secures said outer portion to said predetermined one of said joint pipes, and ii) said first flat surface thereof rigidly adhered to the second flat surface of said predetermined one of said joint pipes.

4. A heat exchanger according to claim 3, wherein the first opening in the outer portion is square and the tongue members are provided on each side of the opening.

5. A heat exchanger according to claim 3, wherein the outer portion comprises nail elements for connecting the inner and outer portions to one another.

6. A heat exchanger according to claim 3, wherein said joint pipes are adapted to carry a refrigerant therethrough, each of said joint pipes having an axis perpendicular to the tubes.

7. A heat exchanger according to claim 3, wherein the header tanks, the tubes and the joint pipes are made of an aluminum alloy.

8. A heat exchanger according to claim 3, wherein the joint pipes connect an inner side of the header tanks with a refrigerant pipe.

9. A heat exchanger according to claim 3, wherein said first and second flat surfaces are rigidly adhered to one another by a brazed joint.

10. A heat exchanger, comprising:

first and second header tanks, each comprising an inner and outer portion, each said outer portion comprising a square first opening therein, each said outer portion having a plurality of curled tongue members provided on each side of the first opening;

a plurality of tubes adapted to carry a heat exchange medium therethrough, said tubes each having opposite ends connected to a respective one of said header tanks so as to permit said header tanks to be in fluid communication with one another; and first and second joint pipes connected to said first and second header tanks respectively, each of said joint pipes having a second opening, and each said outer portion having the curled tongue members thereof being disposed in said second opening of a respective one of said joint pipes in a manner which secures each said outer portion to a respective one of said joint pipes.

* * * * *